United States Patent [19]

Lyle et al.

[11] 3,933,659

[45] Jan. 20, 1976

[54] EXTENDED LIFE FUNCTIONAL FLUID

[75] Inventors: Richard E. Lyle, El Cerrito; Edward G. Foehr, San Rafael, both of Calif.

[73] Assignee: Chevron Research Company, San Francisco, Calif.

[22] Filed: July 11, 1974

[21] Appl. No.: 484,914

[52] U.S. Cl. ..... 252/32.7 E; 252/42.7; 252/51.5 R; 252/51.5 A; 252/75; C10M/7/46

[51] Int. Cl.[2].. C10M 1/48; C10M 3/42; C10M 5/24

[58] Field of Search ..... 252/32.7 E, 42.7, 51.5 R, 252/51.5 A, 75

[56] References Cited

UNITED STATES PATENTS

| | | | |
|---|---|---|---|
| 3,652,410 | 3/1972 | Hollinghurst et al. | 252/32.7 E |
| 3,796,662 | 3/1974 | Lyle et al. | 252/32.7 E |
| 3,844,960 | 10/1974 | Breitigam et al. | 252/32.7 E |
| 3,853,773 | 12/1974 | Martin et al. | 252/32.7 E |

*Primary Examiner*—Delbert E. Gantz
*Assistant Examiner*—I. Vaughn
*Attorney, Agent, or Firm*—G. F. Magdeburger; C. J. Tonkin; L. L. Priest

[57] ABSTRACT

Functional fluid lubricating oil compositions are provided which comprise (A) a major amount of an oil of lubricating viscosity, and (B) an effective amount of each of the following: (1) an alkenyl succinimide, (2) a Group II metal salt of a dihydrocarbyl dithiophosphoric acid, (3) a compound selected from the group consisting of (a) fatty acid esters of dihydric and other polyhydric alcohols, and oil soluble oxyalkylated derivatives thereof, (b) fatty acid amides of low molecular weight amino acids, (c) N-fatty alkyl-N,N-diethanol amines, (d) N-fatty alkyl-N,N-di(ethoxyethanol) amines, (e) N-fatty alkyl-N,N-di-poly(ethoxy) ethanol amines, and (f) mixtures thereof, and (4) a basic sulfurized alkaline earth metal alkyl phenate. Such lubricating compositions are useful as functional fluids in systems requiring fluid coupling, hydraulic fluid and/or lubrication of relatively moving parts. The lubricating compositions of the invention are particularly useful as the functional fluid in automatic transmissions, particularly in passenger automobiles.

10 Claims, No Drawings

EXTENDED LIFE FUNCTIONAL FLUID

BACKGROUND OF THE INVENTION

1. Field of the Invention

This invention relates to lubricating oil compositions, particularly to lubricating oil compositions useful as functional fluids in systems requiring fluid coupling, hydraulic fluid, and/or lubrication of relatively moving parts. In a preferred embodiment, this invention relates to a lubricating oil composition useful as the functional fluid in automatic transmissions, particularly automatic transmissions used in passenger automobiles.

The trend today is towards longer and longer periods of time between servicing of the modern passenger automobile. This trend includes servicing of the automatic transmission. Automobile manufacturers, for the convenience of their customers, are seeking to extend the time between fluid changes in the automatic transmission to greater and greater mileages.

Automatic transmission fluids are required to have a variety of desirable characteristics besides acting as a satisfactory fluid coupling or torque converter. Among these are allowing the transmission to shift smoothly, allowing the transmission to lock up during a shift from one speed to another within a certain specified period of time, and lubricating relatively moving parts such as bearing surfaces and clutch plates.

An automatic transmission is a complicated piece of machinery. It includes a turbine drive unit with a torque converter and one or more clutches which are engaged and disengaged automatically by an intricate hydraulic control unit. In a typical automatic transmission, the clutches are made up of alternating steel plates and steel plates faced on both sides with a friction material such as compressed paper.

To achieve a smooth shift, the clutch plates are not abruptly engaged, but are compressed together at a controlled rate, with pressure varying with speed and torque. Therefore, for a finite measurable period of time, the friction facings and steel surfaces are in relative motion until complete engagement occurs. The time lapse between when shifting begins and relative motion between the plates ceases is called the time to lock up.

This time to lock up is an important specification to be met in qualifying an automatic transmission fluid for use in the transmission of an automobile manufacturer. In order to not cause a great strain on the drive train and obtain a smooth shift, maximum and minimum times to lock up are specified.

An automatic transmission should not emit noises when it shifts. This problem is most noticeable in certain transmissions; especially when they are used with high output engines (e.g., 400 cubic inches displacement and larger). It occurs during manual shifting (e.g., Park to Drive, Park to Reverse, Drive to Reverse, etc.) of the transmission. The noise emitted is generally described as a "clunk."

The functional fluid used in automatic transmissions is subjected to very severe conditions of use. The temperature of the automatic transmission fluid under normal operating conditions will reach 275°F. Under more severe conditions, such as during climbing hills, trailer towing, stop-and-go traffic in the metropolitan areas, etc., the fluid temperature can increase significantly above this, up to, for example, 325°F and higher. In addition, the fluid is constantly being pumped and agitated, thereby being brought into intimate contact with the atmosphere within the automatic transmission. Fresh air and atmospheric moisture are constantly introduced through the transmission housing breather tube. Under these conditions of high temperature and thorough mixing, the fluid tends to be oxidized, forming undesirable contaminants in the fluid, and modifying or impairing the desirable characteristics of the fluid.

The degradation products which are produced during use cause the characteristics of the functional fluid to change. The smoothness of the shift can be lost and the time it takes the transmission to lock up during a shift from one speed to another increases. As will be appreciated, when the lock-up time increases, the clutch facings are in relative motion to each other for a greater period of time, thereby allowing for the possibility of greater wear, higher clutch facing temperatures, and greater heat input to the fluid.

Eventually, the time to lock up will increase until it becomes too long to be acceptable. Prior to this point, the automatic transmission fluid must be changed to avoid permanent damage to clutches and/or bands.

In addition to the possibility of permanent damage to friction members, the degraded oil contains various contaminants which can either coagulate and settle out or plate out as a film throughout the transmission. This is particularly detrimental in the small passages and close-fitting spool valves of the hydraulic control unit where a small amount of deposit can significantly change the size of the openings, cause sluggish valve movement thereby changing flow rates and pressures which, in turn, can markedly affect the performance of the entire transmission. In addition, if particles or lumps form in the fluid, they could completely block small openings such as in screens or filters and totally inpair the function of the transmission.

What is needed for the modern day automatic transmission is a fluid which is stable over an extended use interval, retains its shifting characteristics over this interval and reduces or eliminates noise generation and emission in the transmission.

DESCRIPTION OF THE PRIOR ART

Using amines and amine salts including hydroxy-alkyl amines in lubricating compositions is known. See Stuart and Lowe, U.S. Pat. No. 2,758,086. Lubricating oil compositions containing heterocyclic nitrogen-containing detergent polymers, oil-soluble salts of aminoimides of long-chain mono-substituted polymeric hydrocarbyl succinic anhydrides and thiophosphates are described in Henderson et al, U.S. Pat. No. 3,265,618.

Using metal salts of phosphorodithioic acid to improve the oxidative stability of lubricating compositions has been often disclosed. See, for example, Meinhardt, U.S. Pat. No. 3,347,790, and Rutherford et al., U.S. Pat. No. Re. 22,829. The combination of N,N-dialkyl aminoalkylene alkenyl succinimides and metal dithiophosphates are disclosed as being good detergent combinations in crankcase lubricating oils which prevent the formation of sludges and varnishes without contributing to the deposit of large amounts of ash in the combustion chamber are described in Anderson et al., U.S. Pat. No. 3,018,247.

"Lubricating Oil Compositions suitable for use as automatic transmission fluids" are described in Butler et al., U.S. Pat. 3,396,109. These compositions, which contain the reaction product of a dihydrocarbyl phosphonodithioic acid with an amine, are described as oxidation inhibitors and anti-wear agents.

Lube oil compositions containing a basic alkaline earth metal petroleum sulfonate, a copolymer of C-vinyl pyridine and an alkyl methacrylate, and a succinimide of mono(polyolefin)succinic anhydride and a polyalkylene polyamine have been described as useful as turbine oils, gear oils, etc., in Henderson, U.S. Pat. No. 3,438,897. These compositions can optionally contain zinc dialkyl dithiophosphate.

Automatic transmission fluids containing an oxyalkylated tertiary amine, a substituted imidazoline, and a polyalkenyl-substituted succinimide are disclosed in Bickham, U.S. Pat. No. 3,634,256. Bickham says the oxyalkylated tertiary amine and the substituted imidazoline interact to change the shape of the friction curve.

SUMMARY OF THE INVENTION

The lubricating oil compositions of this invention comprise (a) a major amount of an oil of lubricating viscosity, and (b) an effective amount of each of the following: (1) an alkenyl succinimide, (2) a Group II metal salt of a dihydrocarbyl dithiophosphoric acid, (3) a compound selected from the group consisting of (a) fatty acid esters of dihydric alcohols, (b) fatty acid esters of other polyhydric alcohols, (c) oil-soluble oxyalkylated derivatives of fatty acid esters of dihydric alcohols, (d) oil-soluble oxyalkylated derivatives of fatty acid esters of polyhydric alcohols, (e) fatty acid amides of low molecular weight amino acids, (f) N-fatty alkyl-N,N-diethanol amines, (g) N-fatty alkyl-N,N-di-(ethoxyethanol) amines, (h) N-fatty alkyl-N,N-di-poly(ethoxy) ethanol amines, and (i) mixture thereof, and (4) a basic sulfurized alkaline earth metal alkyl phenate. These lubricating oil compositions are useful as the functional fluids in systems requiring fluid coupling, hydraulic fluids and/or lubrication of relatively moving parts. These fluids are particularly valuable since their useful life is significantly greater than functional fluids currently available.

DESCRIPTION OF THE INVENTION

As described above, the extended life functional fluid compositions of this invention comprise a major amount of aan oil of lubricating viscosity and an effective amount of each of: an alkenyl succinimide; a Group II metal salt of a dihydrocarbyl dithiophosphoric acid; a compound selected from fatty acid esters of dihydric or other polyhydric alcohols, oil-soluble oxyalkylated derivatives of fatty acid esters of dihydric or other polyhydric alcohols, fatty acid amides of low molecular amino acids, N-fatty alkyl-N,N-diethanol amines and oil-soluble oxyalkylated derivatives thereof, and mixtures thereof; and, a basic sulfurized alkaline earth metal alkyl phenate.

The alkenyl succinimide is present to, among other things, act as a dispersant and prevent formation of deposits formed during operation of the system containing the functional fluid. Alkenyl succinimides are well known. They are the reaction product of a polyolefin polymer-substituted succinic anhydride with an amine, preferably a polyalkylene polyamine. The polyolefin polymer-substituted succinic anhydrides are obtained by reaction of a polyolefin polymer or a derivative thereof with maleic anhydride. The succinic anhydride thus obtained is reacted with the amine. The preparation of the alkenyl succinimides has been described many times in the art. See, for example, U.S. Pat. No. 3,390,082, in Cols. 2 through 6, wherein such a description is set forth. Many of the alkenyl succinimides prepared by the techniques set forth therein are suitable for use in the present invention.

Particularly good results are obtained with the lubricating oil compositions of this invention when the alkenyl succinimide is a polyisobutene-substituted succinic anhydride of a polyalkylene polyamine.

The polyisobutene from which the polyisobutene-substituted succinic anhydride is obtained by polymerizing isobutene and can vary widely in its compositions. The average number of carbon atoms can range from 30 or less to 250 or more, with a resulting number average molecular weight of about 400 or less to 3,000 or more. Preferably, the average number of carbon atoms per polyisobutene molecule will range from about 50 to about 100 with the polyisobutenes having a number average molecular weight of about 600 to about 1,500. More preferably, the average number of carbon atoms per polyisobutene molecule ranges from about 60 to about 90, and the number average molecular weight ranges from about 800 to 1,300. The polyisobutene is reacted with maleic anhydride according to well-known precedures to yield the polyisobutene-substituted succinic anhydride.

The substituted succinic anhydride is reacted with a polyalkylene polyamine to yield the corresponding succinimide. Each alkylene radical of the polyalkylene polyamine usually has up to about 8 carbon atoms. The number of alkylene radicals can range up to about 8. The alkylene radical is exemplified by ethylene, propylene, butylene, trimethylene, tetramethylene, pentamethylene, hexamethylene, octamethylene, etc. The number of amino groups generally, but not necessarily, is one greater than the number of alkylene radicals present in the amine, i.e., if a polyalkylene polyamine contains 3 alkylene radicals, it will usually contain 4 amino radicals. The number of amino radicals can range up to about 9. Preferably, the alkylene radical contains from about 2 to about 4 carbon atoms and all amine groups are primary or secondary. In this case, the number of amine groups exceeds the number of alkylene groups by 1. Preferably the polyalkylene polyamine contains from 3 to 5 amine groups. Specific examples of the polyalkylene polyamines include ethylenediamine, diethylenetriamine, triethylenetetramine, propylenediamine, tripropylenetetramine, tetraethylenepentamine, trimethylenediamine, pentaethylenehexamine, di-(trimethylene)triamine, tri(hexamethylene)tetramine, etc.

Other amines suitable for preparing the alkenyl succinimide useful in this invention include the cyclic amines such as piperizine, morpholine and dipiperizines.

Preferably the alkenyl succinimides used in the compositions of this invention have the following formula:

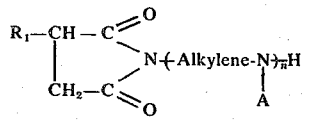

I wherein:

a. R1 represents an alkenyl group, preferably a substantially saturated hydrocarbon prepared by polymerizing aliphatic mono-olefins. Preferably R1 is prepared from isobutene and has an average number of carbon atoms and a number average molecular weight as described above.

b. the "Alkylene" radical represents a substantially hydrocarbyl group containing up to about 8 carbon atoms and preferably containing from about 2–4 carbon atoms as described hereinabove.

c. A represents a hydrocarbyl group, an amine-substituted hydrocarbyl group, or hydrogen. The hydrocarbyl group and the amine-substituted hydrocarbyl groups are generally the alkyl and amino-substituted alkyl analogs of the alkylene radicals described above. Preferably A represents hydrogen.

d. *n* represents an integer of from about 1 to 10, and preferably from about 3–5.

The alkenyl succinimide is present in the lubricating oil compositions of the invention in an amount effective to act as a dispersant and prevent the deposit of contaminants formed in the oil during operation of the system containing the functional fluid. This effective amount can vary widely and is relatively high compared to the levels of alkenyl succinimide normally used in lubricating oils. For example, the amount of alkenyl succinimide can range from about 1.4 percent to about 4 percent weight of the total lubricating oil composition. Preferably the amount of alkenyl succinimide present in the lubricating oil composition of the invention ranges from about 1.75 to about 2.25 percent by weight of the total composition.

As discussed above, the lubricating oil compositions of the invention contain a Group II metal salt of a dihydrocarbyl dithiophosphoric acid. One function of this salt is to act as an oxidation inhibitor thereby preventing the formation of a variety of oxygenated hydrocarbon products which impair the usefulness and shorten the useful life of the lubricating oil.

As stated above, the temperatures to which the functional fluids or automatic transmissions are subjected are often severe. Under these thermally severe conditions, not only is the lubricating oil quite prone to oxidation, but antioxidant additives quite often undergo thermal degradation. Accordingly, for a functional fluid to have an extended useful life, the oxidation inhibitor added to the lubricating oil must have good thermal stability at these relatively high tempatatures, or its thermal degradation products must also exhibit antioxidation properties.

It has now been found that the above-mentioned Group II metal salts of dihydrocarbyl dithiophosphoric acids exhibit thantioxidant and thermal stability properties required for the severe service proposed. Group II metal salts of phosphorodithioic acids have been described previously, See, for example, U.S. Pat. No. 3,390,080, cols. 6 and 7, wherein these compounds and their preparation are described generally. Suitably, the Group II metal salts of the dihydrocarbyl dithiophosphoric acids useful in the lubricating oil composition of this invention contain from about 4 to about 12, preferably 4 to 8 carbon atoms in each of the hydrocarbyl radicals. An excellent antioxidant is obtained when the hydrocarbyl radicals are the remainder of mixed primary octanols. Another excellent antioxidant is obtained from a mixture of isobutyl alcohol and mixed primary hexanols. The metals suitable for forming these salts include barium, calcium, strontium, zinc and cadmium, of which zinc is preferred.

Preferably, the Group II metal salt of a dihydrocarbyl dithiophosphoric acid has the following formula:

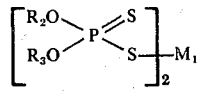

II wherein:

e. R2 and R3 each independently represent hydrocarbyl radicals as described above, and f. M1 represents a Group II metal cation as described above.

The dithiophosphoric salt is present in the lubricating oil compositions of this invention in an amount effective to inhibit the oxidation of the lubricating oil. This effective amount can vary widely and typically ranges from about 0.5 to about 1.5 percent by weight of the total composition, preferably the salt is present in an amount ranging from about 0.75 to about 1.0 percent by weight of the total lubricating oil composition.

The lubricating oil compositions of the invention contain one or more compounds which act principally as a friction modifier to give the lubricating oil the proper frictional characteristics. These frictional characteristics are particularly important where the functional fluid is to be used in automatic transmissions. The frictional properties of the oil are an important factor in how the oil-lubricated clutch plates lock up during shifting. Each manufacturer of automaatic transmissions specifies certain lock-up characteristics for the transmissions he manufactures. Various friction modifiers are introduced into the functional fluid to give the oil the proper characteristics to meet the "shift feel" requirements of various manufacturers. "Shift feel" is, to some extent, a subjective judgement made by the auto manufacturers. However, it can be analyzed objectively by the effect the friction modifier has on the static and kinetic coefficients of friction of the oil. The friction modifiers used in the oils of this invention allow custom design of these coefficients to meet the requirements of the various auto manufacturers.

The friction modifiers used in the lubricating oil compositions of the invention include the fatty acid esters of dihydric and other polyhydric alcohols and oil-soluble oxyalkylated derivatives of these esters.

The fatty acid moiety must be of sufficient length to make the ester oil soluble. Suitably, the fatty acid moiety contains from 12 to 20 carbon atoms exclusive of oxyalkylation, which can be in a branched, but preferably are in a predominately straight chain containing from zero to one, preferably one, site of olefinic unsaturation. The fatty acid moiety is conveniently derived from naturally occurring substances. For example, castor oil is predominately a triglyceride in which the esterified acids are more than 85% mono- and dihydroxy-substituted 18 carbon atom acids with 0-1 sites of olefinic unsaturation.

In a preferred embodiment of this invention, the fatty acid ester has one of the following formulae:

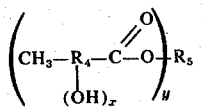

III

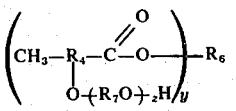

IV wherein:

g. R4 represents an alkylene or alkenylene, preferably substantially straight chain, containing from 10 to 18, preferably 14–16 carbon atoms and zero to one, preferably one site of olefinic unsaturation, such as the alkenylene necessary to complete oleic acid:

h. R5 represents the remainder of a dihydric or polyhydric alcohol containing from 2 to 5 carbon atoms and 2 to 4 hydroxyl groups;

i. R6 represents the remainder of a dihydric or polyhydric alcohol containing from 2 to 5 carbon atoms and from 2 to 4 hydroxyl groups;

j. R7 represents an alkylene preferably containing from 2 to 3 carbon atoms such as ethylene or propylene. If $z$ represents an integer greater than 1, R7 can represent mixtures of alkylenes. Preferably, R7 does not represent mixed alkylenes;

n. $x$ represents 0, 1 or 2, preferably 0 or 1;

o. $y$ represents 1, 2 or 3, preferably 1 or 3; and p. $z$ represents an integer from 0 to 22, preferably 1 to 7.

As the number of oxyalkylene groups contained in the compounds of Formula IV increases, the oil solubility of the ester is reduced. Accordingly, it is preferred that the total number of oxyalkylene groups be no more than about 22. This is conveniently determined by the hydroxyl number of the compound. This number is determined by reacting the compound with acetic anhydride and then titrating the acetic acid produced with potassium hydroxide. The hydroxyl number is expressed as the number of milligrams of potassium hydroxide needed to neutralize the acetic acid produced by one gram of the compound reacted with the acetic anhydride. Compounds of Formula IV useful in the fluids of this invention preferably are those in which $y$ represents 3, R4 contains about 16 carbon atoms, R7 represents ethylene, and the compound has an hydroxyl number of from 100 to 160. In these compounds, $z$ has an average value of about 1 to about 7.

As discussed above, the fatty acid moiety can be derived from natural sources which yield fatty acids of the requisite carbon content. An excellent source of fatty acids for the preparation of the compounds of Formula III is castor oil. The ricinoleic acid derived therefrom can be esterified with various dihydric and other polyhydric alcohols such as ethylene glycol, propylene glycol, glycerol and pentaerythritol. Another excellent fatty acid is oleic acid obtained from many naturally occurring oils. This acid can be esterified with the same alcohols as the ricinoleic acid above.

An excellent source of the compounds of Formula IV is castor oil. The hydroxyl groups of the ricinoleic acid can be oxyalkylenated with various alkylene oxides such as ethylene oxide or propylene oxide. The molecular weight, hydroxyl number and oil solubility can be controlled by the number of mols of alkylene oxide added to a mol of castor oil. Generally, the compounds useful in the invention are adducts containing not more than 22 mols of alkylene oxide per mol of castor oil.

Hydroxy fatty acid esters which have been found to be highly useful in the compositions of this invention include compositions available under the trade name FLEXRICIN, particularly numbers 9–17 and compositions available under the trade name SURFACTOL, particularly numbers 318 and 340, all of which are available from Baker Castor Oil Company.

Fatty acid esters which have been found to be highly useful in the compositions of this invention include compositions such as pentaerythritol monooleate available under the name PEMOL available from Emery Industries.

Generally, the proper shift feel is obtained when the composition contains from 0.05 to about 0.8 percent weight of the above fatty acid esters based on the total composition. For lubricating oil compositions intended for use in automatic transmissions used in automobiles manufactured by Ford Motor Company, these fatty acid esters should be used in concentrations of from about 0.05 to about 0.3 weight percent, preferably from about 0.1 to about 0.2 weight percent of the composition. For lubricating oil compositions intended for use in automatic transmissions used in automobiles manufactured by General Motors Corporation, these esters should be used in concentrations of from about 0.1 to about 0.6 weight percent, preferably from about 0.15 to about 0.3 weight percent of the composition.

Friction modifiers useful in the lubricating oil compositions of this invention also include fatty acid amides of low molecular weight amino acids.

The fatty acid moiety must be of sufficient length to make the amide oil soluble. Suitable fatty acid moieties include those described above for the fatty acid esters. Suitable acids include those obtained by saponification of naturally occurring substances. For example, castor oil yields ricinoleic acid; various oils including olive oil yield oleic acid; coconut oil yields acids containing predominately 12–14 carbon atom; etc. Preferably, the fatty acid moiety is from oleic acid.

In a preferred embodiment of this invention, the fatty acid amide of low molecular weight amino acids has the following formula:

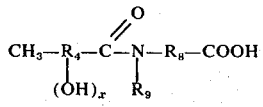

V wherein:

R4 and $x$ have the same meaning as defined above, k. R8 represents an alkylene group containing from 1 to 2 carbon atoms such as methylene, ethylene, ethylidene, and the like, preferably methylene; and l. R9 represents an alkyl group containing from 1 to 6 carbon atoms such as methyl, ethyl, propyl, isopropyl, butyl, i-butyl, s-butyl, t-butyl, pentyl, amyl, hexyl and the like, preferably containing 1 to 2 carbon atoms and more preferably is methyl.

Fatty acid amides of low molecular weight amino acids include sarcosine oleylamide available commercially under the trade name SARKOSYL O from Gergy Industrial Chemicals.

Generally, the proper shift feel is obtained with these fatty acid amides at about the same concentration ranges as specified above for the fatty acid esters. However, these amides appear to be slightly less effective in friction modification than the esters. Thus in the ranges specified above, to obtain the same friction modification, the esters will be used in the lower part of the concentration ranges and amides will be used in the upper part of the concentration ranges specified.

The friction modifiers used in the lubricating oil of the invention also include tertiary amines, particularly those selected from N-fatty alkyl-N,N-di-ethanol amines, N-fatty alkyl-N,N-di-(ethoxyethanol)amines and N-fatty alkyl-N,N-di-poly(ethoxy)ethanolamines.

The fatty alkyl nitrogen substituent must be of sufficient length to make the amine oil soluble. Suitably, the fatty alkyl nitrogen substituent contains from 12 to 18 carbon atoms, which can be in a branched, but preferably are in a predominantly straight chain. The fatty alkyl moiety is conveniently obtained from naturally occurring substances containing the requisite length of alkyl chain. For example, the alkyl chain is suitably derived from substances such as coconut oil containing approximately 69–70 percent carbon chains having 12–14 carbon atoms. Suitably, also, the alkyl moiety can be derived from substances such as oleoamine containing predominantly alkyl chains having 18 carbon atoms. Preferably, the alkyl moiety is derived from coconut oil.

In a preferred embodiment of this invention, the tertiary amine has the following formula:

VI 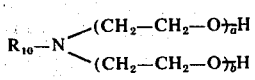

wherein:

m. R10 represents a fatty alkyl group containing from 12 to 18 preferably 12 to 14 carbon atoms, and g. *a* and *b* each represent a positive whole integer greater than zero such that the sum of *a* and *b* represents a value of from 2 to 30.

As the sum of *a* and *b* increases, the oil solubility of the amine is reduced. Accordingly, it is preferred that the sum of *a* and *b* represents a value of from 2 to 15 and, more preferably, from 2 to 5. Most preferably, *a* and *b* each represent 1.

As discussed above, the fatty alkyl group represented by R10 can be derived from naturally occurring substances containing alkyl groups predominantly of the requisite lengths, preferably the fatty alkyl group represented by R10 is derived from coconut oil and contains predominately 12 to 14 carbon atoms.

The tertiary amines can be prepared by reacting the fatty alkyl amine with the appropriate number of mols of ethylene oxide. Tertiary amines derived from naturally occurring substances such as coconut oil and oleoamine are available from Armour Industrial Chemical Company under the trade name ETHOMEEN. Particularly suitable compounds are those of the ETHOMEEN-C and ETHOMEEN-O series.

Generally, the proper shift feel is obtained when the composition contains these tertiary amines in about the same concentration ranges as specified above for the fatty acid esters.

The lubricating oil compositions of the invention contain a basic sulfurized alkaline earth metal alkyl phenate. One of the functions of this phenate is to act as a detergent and dispersant. Among other things, it prevents the deposit of contaminants formed during high temperature operation of the system containing the functional fluid.

The basic sulfurized alkaline earth metal alkyl phenates are well known. Many of the phenates of this type have been used as additives for lubricating oil compositions. These salts are obtained by a variety of processes such as treating the neutralization product of an alkaline earth metal base and an an alkylphenol with sulfur. Conveniently the sulfur, in elemental form, is added to the neutralization product and reacted at elevated temperatures to produce the sulfurized alkaline earth metal alkyl phenate.

If more alkaline earth metal base were added during the neutralization reaction than was necessary to neutralize the phenol, a basic sulfurized alkaline earth metal alkyl phenate is obtained. See, for example, the process of Walker et al, U.S. Pat. No. 2,680,096. Additional basicity can be obtained by adding carbon dioxide to the basic sulfurized alkaline earth metal alkyl phenate. The excess alkaline earth metal base can be added subsequent to the sulfurization step but is conveniently added at the same time as the alkaline earth metal base is added to neutralize the phenol.

Although carbon dioxide is the most commonly used material to produce the basic or "overbased" phenates, other weak basic acids and acid anhydrides can be used, such as carbonic acid, sulfurous acid, sulfur dioxide, and the like. A process wherein basic sulfurized alkaline earth metal alkylphenates are produced by adding carbon dioxide is shown in Hanneman, U.S. Pat. No. 3,178,368.

The alkyl portion of the alkyl phenate is present to lend oil solubility to the phenate. The alkyl portion can be obtained from naturally occurring or synthetic sources. Naturally occurring sources include petroleum hydrocarbons such as white oil and wax. Being derived from petroleum, the hydrocarbon moiety is a mixture of diffferent hydrocarbyl groups, the specific composition of which depends upon the particular oil stock which was used as a starting material. Suitable synthetic sources include various commercially available alkenes and alkane derivatives which when reacted with the phenol yeild an alkylphenol. Suitable radicals obtained include butyl, hexyl, octyl, decyl, dodecyl, hexadecyl, eicosyl, tricontyl, and the like. Other suitable synthetic sources of the alkyl radical include olefin polymers such as polypropylene, polybutylene, polyisobutylene and the like.

The alkyl group can be straight-chained or branch-chained, saturated or unsaturated (if unsaturated, preferably containing not more than 2 and generally not more than 1 site of olefinic unsaturation). The alkyl radicals will generally contain from 4 to 30 carbon atoms. Generally when the phenol is monoalkylsubstituted, the alkyl radical should contain at least 8 carbon atoms.

The alkaline earth metal of the basic sulfurized alkaline earth metal alkyl phenate suitably includes magnesium, calcium, strontium and barium of which calcium is particularly preferred.

Quite often overbased alkali and alkaline earth metal sulfonates are present in the reaction mixture during the preparation of the phenate. These sulfonates are generally not removed subsequent to the reaction and accordingly are present as a minor component of the phenate when it is added to the lubricating oil compositions of the invention. The presence of this sulfonate does not detract from the usefulness of the phenate in the invention and, in many cases, supplies additional dispersant and detergent properties to the lubricating oil compositions.

Preferably the basic sulfurized alkaline earth metal alkyl phenate is prepared from an alkyl phenate having the following formula:

VII 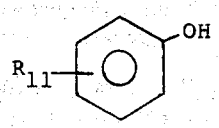

wherein:

r. R11 represents one or more, preferably 1 to 3 alk /l substituents on the benzene ring such as the alkyl substituents described above.

The basic sulfurized alkaline earth metal alkyl phenates are present in the lubricating oil compositions of the invention in an amount effective to substantially prevent the deposit of contaminants formed in the oil during severe high temperature of the system containing the composition. This effective amount can vary widely and typically ranges from about 0.4 to about 4 weight percent phenate in the total composition preferably from about 0.8 to about 2 weight percent phenate in the lubricating oil composition.

AUTOMATIC TRANSMISSION FLUIDS

In a preferred embodiment, the compositions of this invention are particularly well suited for use in automatic transmissions, particularly in passenger automobiles.

Automatic transmission fluids generally have a viscosity in the range from about 75 to 1,000 SUS (Saybolt Universal Seconds) at 100°F and from about 35 to 75 SUS at 210°F. The base oils for the automatic transmission fluids are light lubricating oils and ordinarily have a viscosity in the range of about 50 to 400 SUS at 100°F and 33 to 50 SUS at 210°F. The base stock is generally a lubricating oil fraction of petroleum. It can be either naphthenic or paraffinic base, unrefined, acid refined, hydrotreated, or solvent refined, etc., as required in the particular lubricating need. Also, synthetic oils meeting the necessary viscosity requirements, either with or without viscosity index improvers, may be used as the base stock.

To summarize, the various constituents will be present in the automatic transmission fluid as follows:

The alkenyl succinimide used in this invention generally will be present in the functional fluid in from about 1 to about 4 percent weight, more usually from about 1.50 to about 2.25 percent weight. In concentrates prepared for addition to the base oil prior to use, the alkenyl succinimide can be present in from about 10 to about 35 weight percent.

The Group II metal salt of a dihydrocarbyl dithiophosphoric acid will generally be present in the functional fluid in from about 0.5 to about 1.5 percent weight, more usually from about 0.75 to about 1.0 percent weight. The dithiophosphoric acid salts may be present in concentrates from about 5 to about 20 percent weight.

The friction modifier selected from the fatty acid esters, fatty acid amides, tertiary amines and mixtures thereof will generally be present in the functional fluid in from about 0.05 to about 0.8 percent weight, more usually from about 0.05 to about 0.6 percent weight, depending upon the requirements of the manufacturer of the transmission. These components or mixtures may be present in concentrates in from about 1 to about 3 percent weight.

The basic sulfurized alkaline earth metal alkyl phenate will generally be present in the functional fluid in from about 0.4 to about 4 percent weight, more usually from about 0.8 to about 2 percent weight. The phenate may be present in concentrates from about 5 to about 15 percent weight.

The functional fluid will normally contain a large number of other additives. It is usually necessary to heavily compound such oils in order to meet the exacting requirements specified.

Included among the other additives which can be used are additional oxidation inhibitors, such as, for example, the adduct obtained by combining terpene and phosphorous pentasulfide. Suitable materials are commercially available under the trade names SANTOLUBE and HITEC available from Monsanto Company and Edwin L. Cooper, Ltd., respectively.

Also commonly used in functional fluids are antifoam agents such as the various commercially available fluorosilicone compounds. A particularly good antifoam agent is available from Dow Corning under the name FS 1265 Fluid.

Another useful functional fluid additive is a seal swell agent. A variety of compounds are useful for this function and include the bottoms product from catalytic cracking units used in the production of gasolines. These materials, containing a high percentage of condensed ring aromatics, are commercially available from Lubrizol Corporation under the name Lubrizol 725.

Also included in functional fluids are viscosity improving agents which are normally high molecular weight polymers such as the acrylate polymers. Useful examples include the copolymers of alkyl methacrylate with vinyl pyrrolidine available under the tradename ACRYLOID from Rohm & Haas and terpolymers derived from styrene, alkylacrylates and nitrogen-containing polymer precursors available from Lubrizol Corporation under the name Lubrizol 3700 Series and methacrylates available from Texaco, Inc. Other viscosity improving agents include hydrocarbon polymers such as polyisobutylene or ethylene/propylene copolymers.

These additives will be present in the functional fluid in varying amounts necessary to accomplish the purpose for which they were included. For example, additional oxidation inhibitors such as the terpene-phosphorous pentasulfide adduct may be present in amounts ranging from about 0.1 percent to about 1 percent weight or more. The fluorosilicone antifoam agent will generally be present in from about 2 to about 50 ppm. The viscosity index improver will normally be present in from about 0.5 to about 15 percent by weight of the base oil, more usually from about 2 to about 10 percent by weight of the base oil. The seal swell agent will be present in an amount effective to control the size of the seals with which the functional fluid comes in contact. For example, the bottoms from the catalytic cracking unit will be present in an amount ranging from about 1 to about 10 percent, more usually from about 2 to about 5 percent weight.

Other additives include pour point depressants, antisquawk agents, etc. Numerous automatic transmission fluid additives are listed in U.S. Pat. Nos. 3,156,652 and 3,175,976, which disclosure is incorporated herein by reference.

These various additives are also often incorporated into the concentrates and will be present therein in correspondingly higher concentrations.

EXAMPLES

The following examples are offered by way of illustration and not by way of limitation.

EXAMPLE 1

The "clunk" noise emanating from certain automatic transmissions has been determined to be dependent upon the relationship between the dynamic coefficient of friction and the static coefficient of friction of the automatic transmission fluid. It has been determined that the "clunk" noise could be greatly reduced, if not substantially eleminated, if the dynamic and static coefficients of friction of the automatic transmission fluid were substantially the same.

These coefficients of friction can be determined by using the SAE No. 2 Friction Tester. Briefly, this friction tester comprises an electric motor driving the input shaft of a set of clutch plates from an automatic transmission. The output shaft is attached to a torque lever arm. This in turn operates a transducer to indicate the torque output which is then recorded on a strip chart. The clutch is engaged by compressed air and power to the electric motor is simultaneously shut off. When the clutch plates are engaged, the angular momentum of the electric motor is consumed in the sliding friction between the rotating clutch plates attached to the input shaft and the fixed clutch plates attached to the output shaft.

The quantity of angular momentum energy which can be built up in the electric motor can be varied by attaching various sized flywheel weights to one end of the armature shaft of the electric motor. The torque recorded at the output shaft generally rises rapidly to a relatively constant level and remains at this level (with certain variations depending upon the frictional characteristics of the test fluid) until motor rotation ceases at which time the torque drops to zero.

The dynamic coefficient of friction is determined from the torque recorded on the strip chart. After the rotor has ceased rotation, a lever arm is attached to the output shaft of the armature and torque is applied to determine the static coefficient of friction.

For purposes of testing the fluids of this invention, the General Motors procedure established in 1967 for testing Dexron fluids was followed. Both a low-energy test and a high-energy test were used. Table III shows the results of testing an automatic transmission fluid meeting all the requirements established by Ford Motor Company in their Specification M2C33-G specification. This fluid labeled "H" has a static coefficient of friction of about 22-25% higher than the dynamic coefficient of friction. This fluid was then modified by adding friction modifiers. Four different fluids containing four different friction modifiers were prepared and are shown as Fluids 1–4 in Table III.

Table I shows the compositions of Fluid H. Table II shows the friction modifiers numbered 1–4 which were added to Fluid H to prepared fluids 1–4 respectively.

TABLE I

| Composition of Fluid H | |
|---|---|
| Component | Quantity |
| Viscosity index improver - commercially available styrene/alkylacrylate/nitrogen-containing polymer precursor terpolymer | 5.35% w |
| Alkenyl succinimide derived by reacting a polyisobutene (number average molecular weight about 950) substituted succinic anhydride with tetraethylpentamine; mol ratio of amine to anhydride = 0.87 | 1.75% w |
| Zinc di(isobutyl/mixed primary hexyl) dithiophosphate | 10.0 mM/kg |
| Carbonated, sulfurized calcium polypropylenephenate; mol ratio of lime to phenol = 1.0, contains 5.25% calcium | 12.5 mM/kg |
| Dibutyl-p-cresol | 0.15 mM/kg |
| Antifoam agent - commercially available fluorosilicone | 15 ppm |
| Seal Swell agent - commercially available hydrocarbon obtained as a bottoms cut from the stream from a catalytic cracking unit used to produce gasoline; predominately condensed ring aromatic compounds | 4.0% w |
| Eastern base oil having a viscosity of 109 SUS at 100°F and 40 SUS at 210°F | |

TABLE II

| Friction Modifiers | |
|---|---|
| No. | Modifier |
| 1 | N,N-diethanol cocoamine |
| 2 | sarcosine oleylamide |
| 3 | pentaerythritol monooleate |
| 4 | glyceryl monoricinoleate |

TABLE III

| Fluid | % w Modifier | Coefficients of Friction High Energy | | Low Energy | |
|---|---|---|---|---|---|
| | | $F_K$ | $F_S$ | $F_K$ | $F_S$ |
| H | — | 0.1353 | 0.1658 | 0.1373 | 0.1712 |
| 1 | 0.15 | 0.1337 | 0.1427 | 0.1355 | 0.1498 |
| 2 | 0.1 | 0.1319 | 0.1391 | 0.1337 | 0.1391 |
| 3 | 0.1 | 0.1319 | 0.1373 | 0.1391 | 0.1427 |
| 4 | 0.2 | 0.1319 | 0.1266 | 0.1407 | 0.1355 |

As can be seen from the data in Table III, all four of the modified functional fluids (fluids 1–4) have static coefficients of friction very nearly the same as the dynamic coefficient of friction. On the other hand, Fluid H has a static coefficient of friction substantially higher than its dynamic coefficient of friction.

EXAMPLE 2

All five fluids described in Example 1 and listed in Table III were tested for antiwear performance in the well-known Four-Ball Wear test and Timken test.

The Four-Ball Wear test is described in Boner, *Gear and Transmission Lubricants*, Reinhhold Publication Corporation (1964) at pages 222–224. In this test, the fourth ball is rotated at 600 rpm for 120 minutes. The test lubricant is at 200°±5°F.

In the Timken test a cylindrical steel test specimen is rotated in contact with a flat surface of a fixed steel block. The steel block and the rotating cylinder are immersed in the test lubricant which is at 200°±5°F. The cylinder is rotated at 800 rpm yielding a rubbing velocity of 406 ft/min. The load on the loading arm which presses the cylinder against the steel block is shown in Table 4. The test is run for 30 minutes at the end of which time the wear scar on the test block is measured.

The test results are shown in Table IV.

TABLE IV

| Antiwear Performance | | | |
|---|---|---|---|
| | Four-Ball | Timken | |
| Fluid | Wear Scar, mm | Load, lb. | Wear Scar, mm |
| H | 0.415, 0.418 | 10 | 0.59, 0.56 |
| 1 | 0.416 | 5 | 0.671 |
| | | 10 | 0.744 |
| 2 | 0.396, 0.406 | 8 | 0.807 |
| 3 | 0.418 | 10 | 0.885 |

TABLE IV-continued

| Fluid | Antiwear Performance Four-Ball Wear Scar, mm | Timken Load, lb. | Timken Wear Scar, mm |
|---|---|---|---|
| 4 | 0.447 | 5 | 0.689 |

The data shown in Table IV demonstrates that the modified functional fluids of this invention exhibit substantially equal antiwear performance as the high-static coefficient of friction fluid which meets all the requirements for use in a Ford automatic transmission fluid.

Example 3

Fluids 1–4 described in Example 1 and shown in Table III were tested by Ford Motor Company at their research laboratory for "anticlunk" performance in a Ford C-6 automatic transmission. All four fluids were found to substantially reduce or completely eliminate the "clunk" noise experienced with Fluid H of Example 1.

What is claimed is:

1. A lubricating oil composition comprising:

a. a major amount of an oil of lubricating viscosity, and

B. an effective amount of each of the following:

1. an alkenyl succinimide,
2. a Group II metal salt of a dihydrocarbyl dithiophosphoric acid,
3. a friction modifier selected from the group consisting of (a) fatty acid esters of polyhydric alcohols, (b) oil-soluble oxyalkylated derivatives of fatty acid esters of dihydric alcohols, (c) oil-soluble oxyalkylated derivatives of fatty acid esters of polyhydricalcohols, (d) fatty acid amides of low molecular weight amino acids, (e) N-fatty alkyl-N,N-diethanol amines, (f) N-fatty alkyl-N,N-di-(ethoxyethanol) amines, (g) N-fatty alkyl-N,N-di-poly(ethoxy)ethanol amines, and (h) mixtures thereof, and
4. a basic sulfurized alkaline earth metal alkyl phenate.

2. A lubricating oil composition of claim 1 wherein 1. said alkenyl succinimide is a polyisobutenyl succinimide of a polyalkylene polyamine,
2. said hydrocarbyl groups of said dithiophosphoric acid contain from 4 to 12 carbon atoms,
3. the fatty alkyl group of said fatty acids contain from 12–20 carbon atoms and said fatty alkyl group of said tertiary amine contains from 12–18 carbon atoms, and
4. said Group II metal of said basic sulfurized alkaline earth metal alkyl phenate is magnesium, calcium, or barium.

3. A lubricating oil composition of claim 1 wherein:

1. said alkenyl succinimide has the following formula:

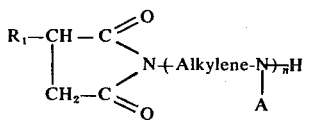

I wherein:

a. $R_1$ represents an alkyl group, b. the "Alkylene" radical contains from 1 to 8 carbon atoms, c. A represents a hydrocarbyl group, an amine substituted hydrocarbyl group, or hydrogen, and d. *n* represents an integer of from 1 to 10;

2. said dithiophosphoric acid salt has the following formula:

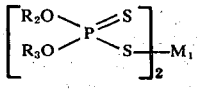

II wherein:

e. $R_2$ and $R_3$ each independently represent hydrocarbon radicals, and f. $M_1$ represents a Group II metal cation:

3*a*. said fatty acid of esters of polyhydric alcohols have the following formula:

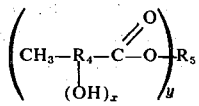

III 3b. said oil-soluble oxyalkylated derivatives of fatty acid esters of polyhydric alcohols have the following formula:

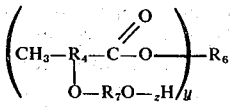

IV 3c. said fatty acid amides of low molecular weight amino acids having the following formula:

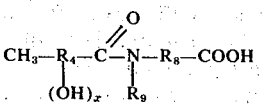

V 3d. said N-fatty alkyl-N,N-diethanol amines, N-fatty alkyl-N,N-di-(ethoxyethanol) amines, and N-fatty alkyl N,N-poly (ethoxy) ethanol amines having the following formula:

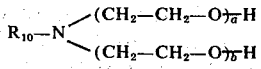

VI wherein:

g. $R_4$ represents an alkylene or alkenylene group containing 10–18 carbon atoms and 0–1 site of olefinic unsaturation;

h. $R_5$ represents the remainder of a dihydric of polyhydric alcohol containing from 2–5 carbon atoms and from 2-4 hydroxyl groups, i. $R_6$ represents the remainder of a polyhydric alcohol containing from 2–5 carbon atoms and from 2–4 hydroxyl groups;

j. $R_7$ represents an alkylene group containing 2–3 carbon atoms;

k. $R_8$ represents an alkylene group containing from 1–2 carbon atoms;

l. $R_9$ represents an alkyl group containing 1–6 carbon atoms;

m. $R_{10}$ represents a fatty alkyl group containing from 12–18 carbon atoms;

n. *x* represents 0, 1 or 2;

o. *y* represents 1, 2 or 3;

p. $z$ represents an integer from 1-22 such that the total number of $—R_7O—$ groups is from 1 to 22; and q. $a$ and $b$ each represent a positive whole integer greater than zero such that the sum of $a$ and $b$ represents a value of from 2–30; and 4. said basic sulfurized alkaline earth metal alkyl phenate is prepared from a compound having the formula:

VII 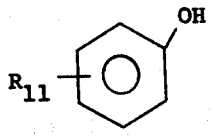

wherein:

r. $R_{11}$ represents from 1 to 3 alkyl substituents on the benzene ring.

4. A lubricating oil composition of claim 3 wherein:

1. in said alkenyl succinimide,
   a. $R_1$ represents an alkenyl group derived from polyisobutene,
   b. said "Alkylene" radical contains from 2 to 4 carbon atoms,
   c. A represents hydrogen, and
   d. $n$ represents 3, 4 or 5;
2. in said dithiophosphoric acid salt,
   e. $R_2$ and $R_3$ each independently represent a hydrocarbyl radical containing from 4 to 12 carbon atoms, and
   f. $M_1$ represents zinc;
3. in said friction modifiers,
   g. $R_4$ represents an alkenylene containing 14 to 16 carbon atoms and one site of olefinic unsaturation,
   k. $R_8$ represents methylene,
   l. $R_9$ represents methyl,
   m. $R_{10}$ represents a fatty alkyl group containing from 12 to 14 carbon atoms,
   n. x represents 0 or 1,
   o. y represents 1 or 3
   p. z represents an integer from 1 to 7 such that the total number of $—R_7O—$ groups is from 1 to 7, and
   q. $a$ and $b$ each represent 1, 2 or 3; and
4. in said phenate,
   r. $R_{11}$ represents 1 to 3 alkyl substituents on the benzene ring, each of said substituents containing 4 to 30 carbon atoms.

5. A lubricating oil composition of claim 4 wherein:

1. in said alkenyl succinimide,
   a. $R_1$ represents a polyisobutenyl radical having a number average molecular weight of from about 800 to about 1300,
   b. said "Alkylene" radical contains 2 carbon atoms, and
   d. $n$ represents 4;
2. in said dithiophosphoric acid salt,
   e. $R_2$ and $R_3$ each independently represent a hydrocarbyl radical containing from 4 to 8 carbon atoms; and
3. in said friction modifiers,
   j. $R_7$ represents an alkylene group containing 2 carbon atoms, and
   g. $a$ and $b$ each represent one.

6. A lubricating oil composition of claim 5 wherein said composition contains:

1. from 1 to 4 weight percent of said alkenyl succinimide,
2. from 0.5 to 1.5 weight percent of said dithiophosphoric acid salt,
3. from 0.05 to 0.8 weight percent of said friction modifier, and
4. from 0.4 to 4 weight percent of said basic sulfurized alkaline earth metal alkyl phenate.

7. A lubricating oil composition of claim 5 wherein said composition contains:

1. from 1.5 to 2.25 weight percent of said alkenyl succinimide,
2. from 0.75 to 1 weight percent of said dithiophosphoric acid salt,
3. from 0.05 to 0.3 weight percent of said friction modifier, and
4. from 0.8 to 2 weight percent of said basic sulfurized alkaline earth metal alkyl phenate.

8. A lubricating oil composition of claim 5 wherein said composition contains:

1. from 1.50 to 2.25 weight percent of said alkenyl succinimide,
2. from 0.75 to 1.0 percent weight of said dithiophosphoric acid salt,
3. from 0.1 to 0.6 weight percent of said friction modifier, and
4. from 0.8 to 2 weight percent of said basic sulfurized alkaline earth metal alkyl phenate.

9. A lubricating oil composition of claim 5 wherein said composition contains:

1. from 1.50 to 2.25 weight percent of said alkenyl succinimide,
2. from 0.75 to 1.0 percent weight of said dithiophosphoric acid salt,
3. from 0.1 to 0.2 weight percent of said friction modifier, and
4. from 0.8 to 2 weight percent of said basic sulfurized alkaline earth metal alkyl phenate.

10. A lubricating oil composition of claim 5 wherein said composition contains:

1. from 1.50 to 2.25 weight percent of said alkenyl succinimide,
2. from 0.75 to 1.0 percent weight of said dithiophosphoric acid salt,
3. from 0.15 to 0.3 weight percent of said friction modifier, and
4. from 0.8 to 2 weight percent of said basic sulfurized alkaline earth metal alkyl phenate.

* * * * *